United States Patent [19]

Fritz

[11] 3,947,349

[45] Mar. 30, 1976

[54] PERMANENT MAGNET HIGH INTENSITY SEPARATOR

[76] Inventor: Alan J. Fritz, 1615 - 9th St., NW., Grand Rapids, Minn. 55744

[22] Filed: Mar. 14, 1975

[21] Appl. No.: 558,337

[52] U.S. Cl. ..... 209/214; 209/223 A; 209/225

[51] Int. Cl.[2] ..... B03C 1/14

[58] Field of Search..... 209/38, 213, 214, 223 R, 209/223 A, 225, 222

[56] References Cited

UNITED STATES PATENTS

| | | | |
|---|---|---|---|
| 2,062,545 | 12/1936 | Weis | 209/223 R |
| 2,074,085 | 3/1937 | Frantz | 209/38 X |
| 3,375,925 | 4/1968 | Carpenter | 209/223 R X |
| 3,690,454 | 9/1972 | Bekhtle | 209/38 |

FOREIGN PATENTS OR APPLICATIONS

| | | | |
|---|---|---|---|
| 252,034 | 5/1926 | United Kingdom | 209/222 |
| 242,797 | 9/1969 | U.S.S.R. | 209/222 |

*Primary Examiner*—Frank W. Lutter
*Assistant Examiner*—Ralph J. Hill
*Attorney, Agent, or Firm*—Merchant, Gould, Smith, Edell, Welter & Schmidt

[57] ABSTRACT

A magnetic separator in which the substance to be treated is passed in a first direction through a body of foraminous, magnetically susceptible material of significant extent, while traversing in a second direction a magnetic field extending in a third direction, the directions being substantially orthogonal. Vibration is applied to the body, preferably axial and preferably linear. The field opposes the passage of magnetic particles through the body while the vibrator promotes the passage of non-magnetic particles, so that they emerge from the body at different locations for separate collection. The body is conveniently a hollow cylinder built up of sections of magnetic stainless steel screening folded and shaped, and the movement of the body is preferably rotation, the substance being applied to an outer cylindrical surface of the body and emerging from an inner, concentric cylindrical surface. A structure comprising a plurality of such hollow cylinders spaced axially along a hollow drum is shown, with means for feeding the substance individually to the several cylinders: the cylinders pass between fixed magnets during a portion of their rotation.

11 Claims, 10 Drawing Figures

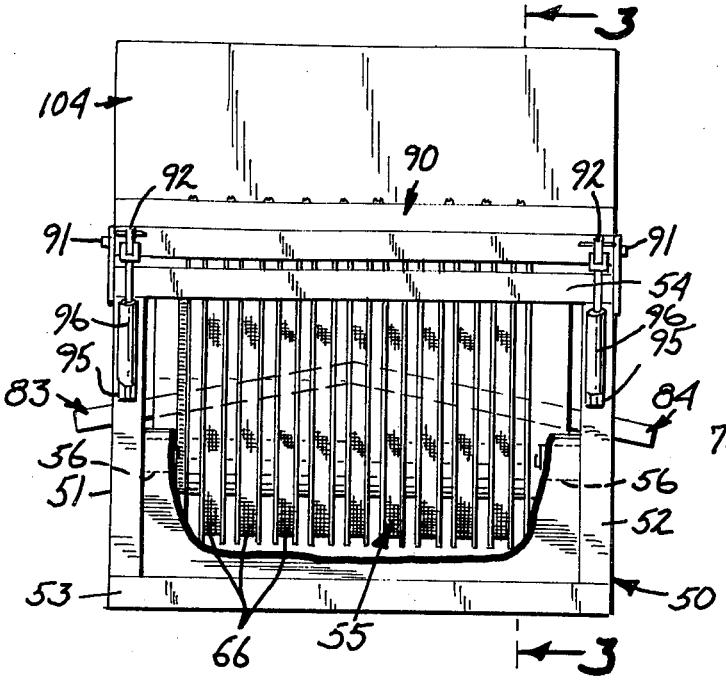
FIG. 2
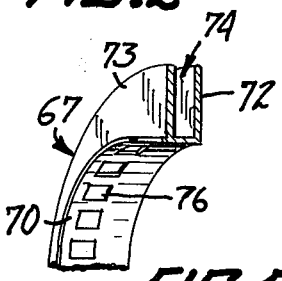
FIG. 5
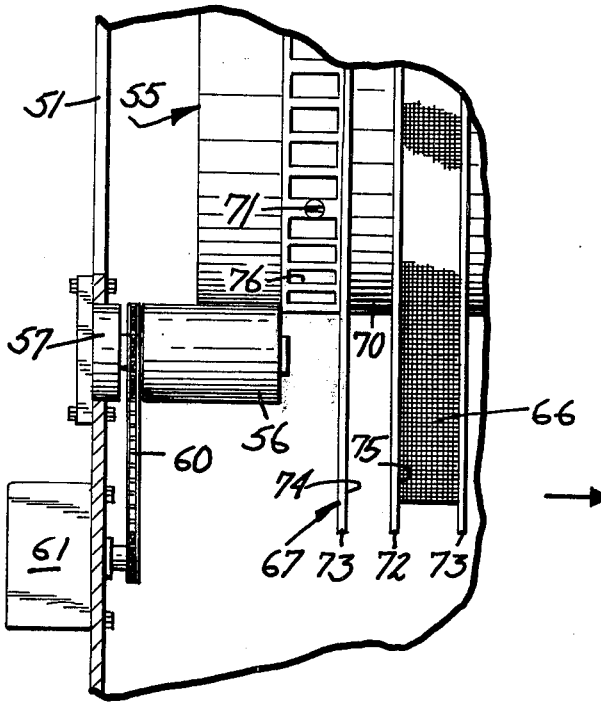
FIG. 4
FIG. 6
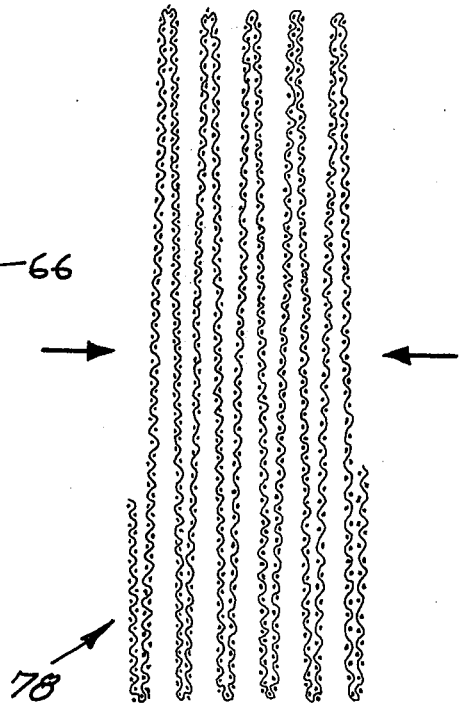

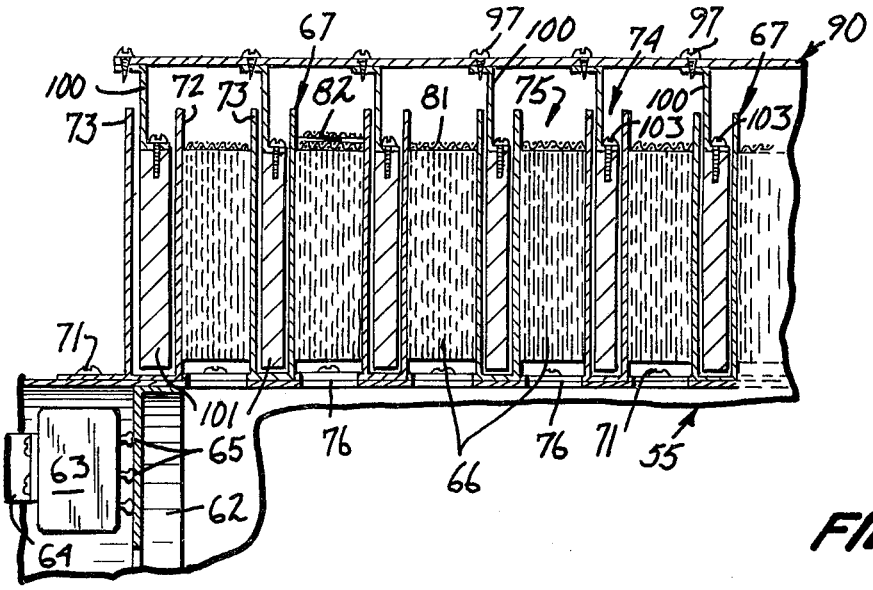
FIG.8
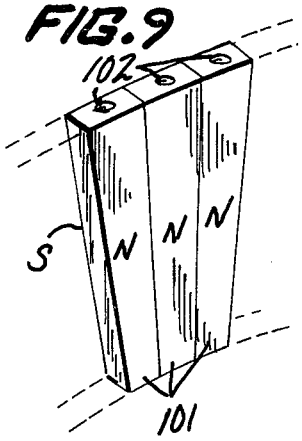
FIG.9
FIG.10
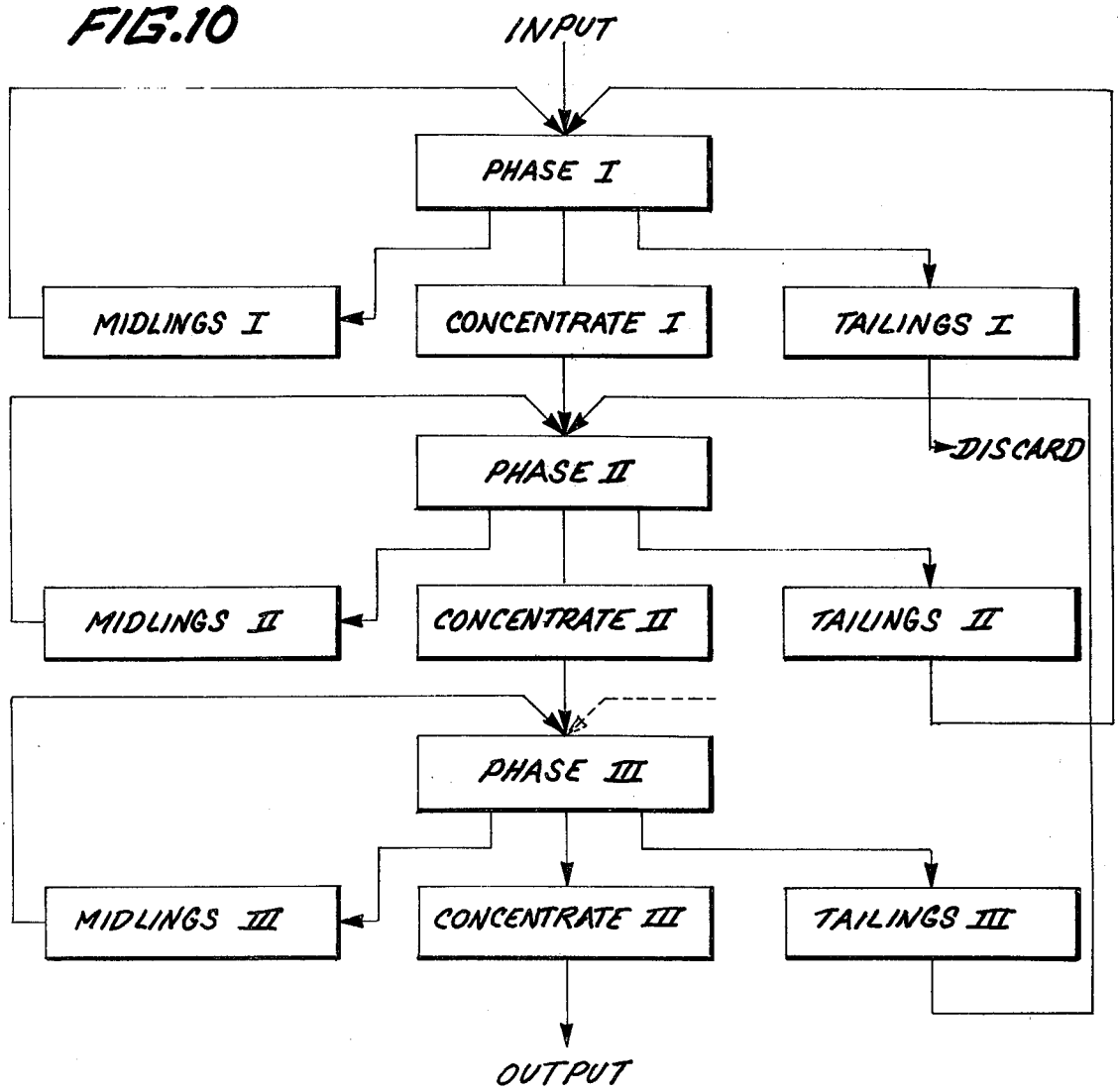

PERMANENT MAGNET HIGH INTENSITY SEPARATOR

BACKGROUND OF THE INVENTION

This invention relates to the field of assorting apparatus, and particularly to apparatus for separating weakly magnetic particles from the non-magnetic particles of a mixture of the two. Here the word "magnetic" refers to particles which are magnetically susceptible, and is not meant to imply particles which are themselves permanently magnetized. The procedure is very important in modern iron mining operations, where the ore is of relatively low grade and contains much gangue. An example is the operation of taconite mining where the ores are of relatively low grade, contain primarily weakly magnetic iron minerals, and are commonly referred to as "oxidized taconite". Such ores are generally no better than the discarded "tailings" of earlier iron mining operations, and indeed those tailings may become a valuable source of iron by the use of my new separator.

Assorting of solids according to their magnetic properties is not new, and devices are known to perform this function, both with particles in the dry state and with particles in the form of a slurry. Such devices have heretofore had the defect that for successful operation on weakly magnetic materials, it has been necessary to use electromagnetics of tremendous size which required complicated auxiliary cooling facilities and consumed many kilowatt hours of electricity per ton of treated material.

SUMMARY OF THE INVENTION

I have discovered that much more satisfactory volumetric separation of weakly magnetic particles from non-magnetic particles takes place when the path traversed by the particles while in the separating field is made longer, and have devised apparatus by which the lengthening of the path is practically accomplished. This I do by providing a foraminous body of magnetically susceptible material, which moves through a magnetic field in a first direction, the magnetic field extending in a second direction, and feeding the particles to pass through the body and the field simultaneously in a third direction, the three directions being preferably orthogonal. The dimensions of the body in the third direction is much greater than any heretofore used, so that the particles remain in the magnetic field for a longer interval, and there is more opportunity for magnetic particles to come into contact with the material of the body and hence to be delayed in passing through the body until it moves out of the field. Vibration is supplied, which not only promotes the passage of non-magnetic particles through the body while in the area of the field, but also promotes the release of magnetic particles after the body moves out of the field.

By making the motion of my foraminous body that of rotation about a horizontal axis, and performing the primary separation near the top of the rotation, I further avoid plugging of the body, as frequently occurs in other separators, because the vibration is continuously supplied and at the bottom of the rotation the body is in essence inverted so that any plugs are more readily released, together with the unseparated material held thereby, for subsequent recycling through the device.

Experiments have shown that apparatus embodying this invention is successful in producing a useful output of high grade concentrate when fed with tailings rejected in previous mining operations.

Various advantages and features of novelty which characterize my invention are pointed out with particularity in the claims annexed hereto and forming a part thereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing.

FIG. 2 is a side view of a separator according to my invention;

FIG. 4 is a fragmentary sectional view of the separator, along the line 4—4 of FIG. 3, to a larger scale;

FIG. 5 is a fragmentary sectional showing of a mounting ring;

FIGS. 6 and 7 schematically show the construction of a separator body section;

FIG. 8 is a fragmentary sectional view along the line 8—8 of FIG. 3, to a larger scale;

FIG. 9 shows schematically a magnetic structure used in the invention; and

FIG. 10 is a flowsheet explaining the use of my new separator.

OPERATING PRINCIPLE OF THE INVENTION

While my invention is applicable to either wet separation or dry separation, I have chosen to illustrate the invention embodied in a dry separator.

Figure 1:
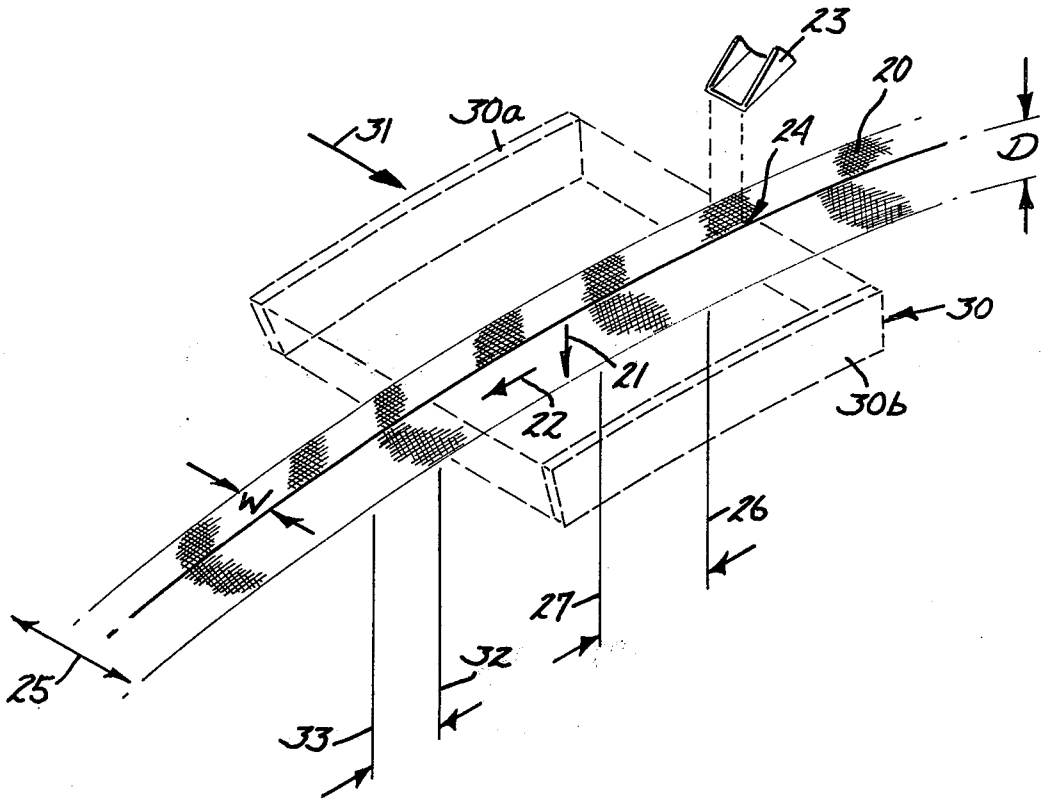
FIG. 1 is a schematic showing of the principle underlying the invention.

Referring now to FIG. 1, there is shown a body 20 of foraminous, magnetically susceptible material having a Width and a Depth. By foraminous material is meant material of a porous or reticulate nature, in which the foramina are in communication to provide continuous, if tortuous, paths extending from surface to surface of the material in at least one direction, indicated by the arrow 21. Means are provided for causing movement of body 20 in the direction shown by the arrow 22, which is preferably orthogonal to the first direction.

The direction of motion of body 20 is generally horizontal. Means 23 are provided for feeding to the upper surface of body 20 at a location 24 a mixture of magnetic and non-magnetic particles of size suitable to follow the tortuous paths through the body and thus emerge at the lower surface. To promote the passage of particles through body 20, the latter is continuously subjected to vibration, by suitable means not shown in the figure, the directions of vibration being that shown by arrow 25. In the absence of any other factor, particles deposited on the upper surface of body 20 at location 23 emerge from the lower surface of the body after an interval during which the body has moved forward. The lengths of the paths followed by the various particles are not identical, and the rates of downward motion of the particles are not all the same, so that particles emerge from body 20 at locations falling between the lines 26 and 27.

Stationary with respect to body 20 is an arrangement 30 for establishing a unidirectional magnetic field extending in the direction of arrow 31, which is preferably orthogonal to the two directions previously defined. This arrangement is preferably in two parts 30*a* and 30*b*, positioned close to and on opposite sides of body 20, and may comprise either an array of permanent magnets or an electromagnetic surface, the former being preferable. The field is relatively intense and relatively concentrated, so that it can be said that each point of body 20 enters the field at a first location and leaves it at a second, these boundaries of the field being readily determinable.

It will be appreciated, since body 20 is of magnetically susceptible material, that when a portion of the body enters the magnetic field, a multitude of induced poles appear in the body along the tortuous paths therethrough, and that these poles attract and hold the magnetic particles which come sufficiently close to them, thus preventing their passing through the body for discharge within the normal discharge interval. It follows that, the depth (dimension D) of the body being sufficiently great, almost every magnetic particle comes close enough to an induced pole, to be held thereby, so that the passage of magnetic particles through the body is magnetically opposed. The extent of the field in the direction of movement of the body is greater than the range 26, 27 so that within that range emergent particles are almost entirely non-magnetic tailings.

As body 20 moves out of the magnetic field, the induced poles disappear, and the magnetic particles are no longer held to the body, but are free to find their way out through its bottom surface. They appear during a range of displacements falling between the lines 32 and 33, and their release is promoted by the continued vibration of the body.

In practice, the operation of the device departs somewhat from the pure theory just described. When a magnetic particle is held in body 20, it may also prevent the passage of other, non-magnetic particles. The flow of non-magnetic particles may also be sufficient to carry away a magnetic particle from an attracted position to be again attracted further down in body 20, so that the density of magnetic particles may be greater near the lower surface of the body. It has been found most practical to dimension the body, and adjust its speed and the rate of feed so that the tailings discharged between lines 26 and 27 are substantially free from magnetic particles, accepting a lower purity of "concentrate" deposited between locations 32 and 33 and recyling this material if necessary to improve its purity.

DESCRIPTION OF THE PREFERRED EMBODIMENT

Figure 3:
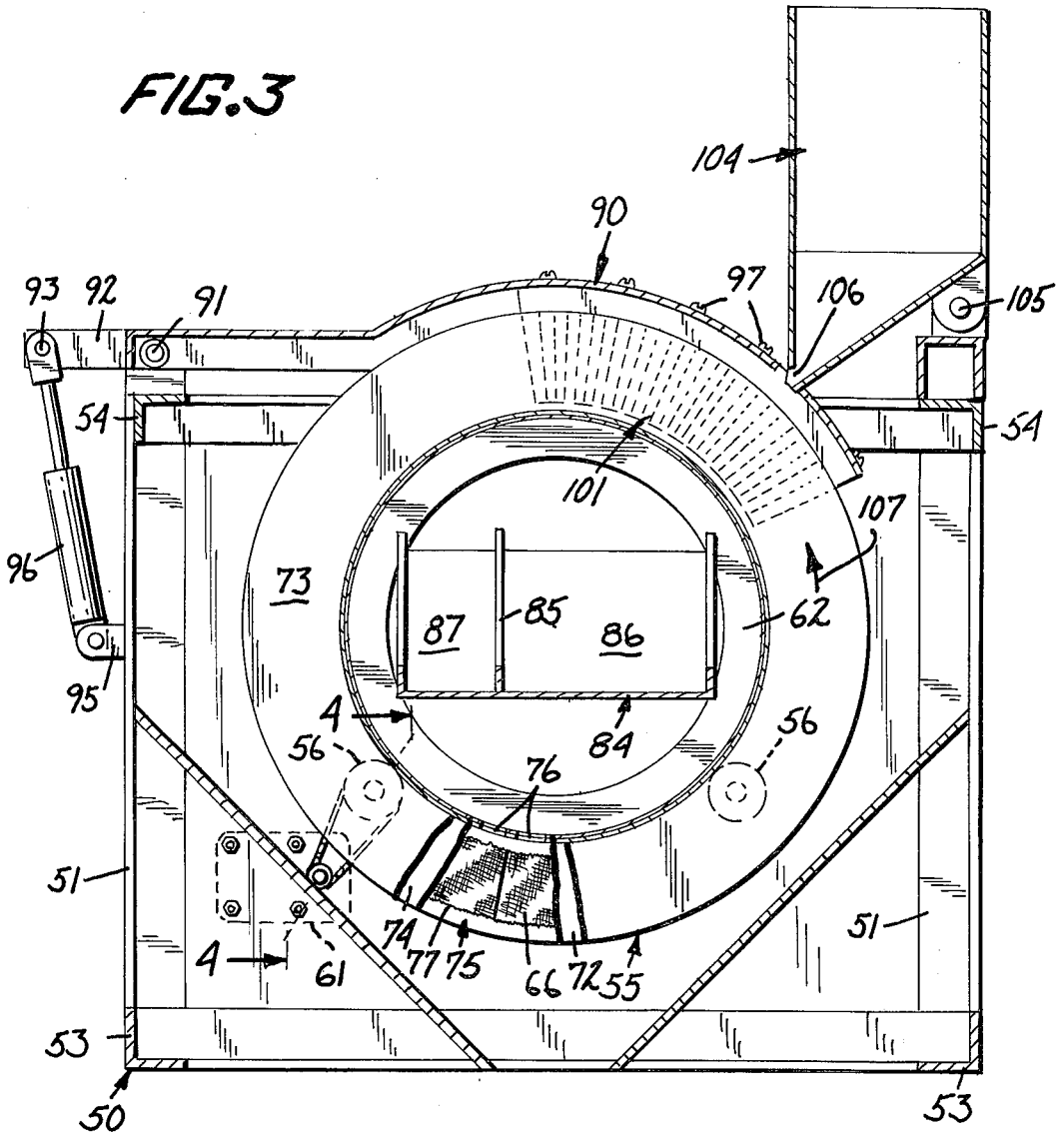
FIG. 3 is a transverse sectional view along the line 3—3 of FIG. 2 on a somewhat larger scale.

A practical embodiment of the invention is in FIGS. 2 and 3, details of construction being shown in FIGS. 4–9. A frame structure 50 is shown to comprise a pair of end members 51 and 52 interconnected by lower structures 53 and upper structures 54. A drum 55 is mounted for rotation about a horizontal axis in frame structure 50, being gravitationally carried on a plurality of rollers 56 pivoted in end members 51 and 52. As shown in FIG. 4, one of the rollers 56, carried in a bearing 57 in end member 52, is arranged to be driven by a sprocket and chain connection 60 from a motor 61 also carried by end member 52, this in turn causing rotation of drum 55 about its axis. The drum is reinforced at its ends by internal flanged discs having central apertures such as disc 62.

A vibrator 63 is carried on a bracket 64 extending inwardly from end member 51, and continuously bears against disc 62 as it rotates, to maintain the drum in vibration: contact between the disc and the drum is by a suitable number of anti-friction contact members 65. The vibration preferably has at least a principal component in the direction of the axis of the drum.

A number of separation elements 66 are mounted on the outside of drum 55 by specially formed mounting rings 67, shown in detail in FIG. 5 and made of aluminum or some other non-magnetic material. Each ring comprises a cylindrical band 70 secured to the drum as by screws 71, and a pair of outwardly extending flat flanges 72 and 73, the former joining the band along one edge and the other extending from the band part way across its width. The space 74 between flanges 72 and 73 is provided for the passage of a magnet structure as will be described below. The separator elements 66 are contained in the spaces 75 between each flange 73 and the flange 72 of the mounting ring adjacent — to the left as seen in FIG. 5. Band 70 is pierced throughout its circumference by an array of apertures 76 which may conveniently be axially directed slots, and the surface of drum 55 underlying the intended locations of ring 67 is also perforated, to allow free passage of particulate material in space 75 through the ring and the drum.

Figure 7:
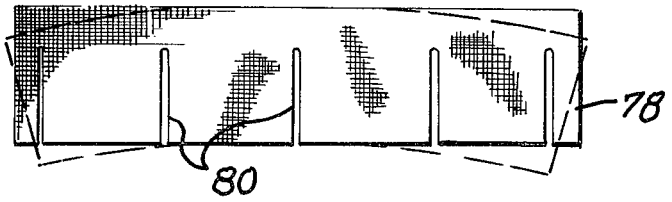

Each of separator elements 66 is constructed from a plurality of arcuate sections to comprise a hollow cylindrical body 77 the width of spaces 75, the radial thickness of the body being substantially the radial dimension of flanges 73. Each arcuate section 78 is made from standard carbon steel screening which is first folded upon itself as shown in FIG. 6 in a number of plys which when well compacted is of thickness to fit into space 75. The block of foraminous or reticulated material so formed is subjected to a series of transverse saw cuts 80 as shown in FIG. 7, permitting it to be bent into the desired form of a segment of a hollow cylinder, as shown in dotted lines in FIG. 7. Each separator body is made of a desired plurality of these sections in circumferential end-to-end relation: where the drum diameter is 4 feet, for example, 15 was found to be a satisfactory number of sections. The sections may be held securely in place by a peripheral strapping 81 of the same screen material, clamped in any suitable fashion at its end as suggested at 82 in FIG. 8.

The use of bodies 66 constructed as described result in a space traversed by a plurality of tortuous and branched passages through which particles may fall by gravity. Magnetic poles are induced in the screen material by reason of the strong magnetic fields of the permanent magnets. The sizes of the particles are known, and the mesh dimensions and number of layers of the screen material are chosen with the particle size in mind, to give a great number of opportunities for each magnetic particle to reach a point where it contacts a south induced pole at one end and a north induced pole at the other, the optimum condition for retention of the particle if it is magnetic. Of course, smaller magnetic particles may be less securely held by contact at one point with an induced pole in the body.

A pair of troughs 83 and 84 are mounted in end members 51 and 52 to pass through the center of drum 55, and slope downwardly towards the ends of the drum. The troughs are provided with a laterally adjustable partition, as shown at 85 in FIG. 3. The portion 86 of trough 84 to the right of partition 85 in FIG. 3 receives and discharges the tailings output of the separator, and will be referred to as the tailings trough, while the portion 87 of the trough to the left of the partition receives and discharges the concentrate output of the separator and will be referred to as the concentrate chute.

A top 90 of transformer iron extends over the top and ends of frame 50. It is pivoted to end members 51, 52, as suggested at 91 in FIG. 3, and a pair of arms 92 extend rearwardly therefrom carrying pivot pins 93 near their extremities. A second set of pivot pins 94 are carried by lugs 95 projecting rearwardly from the end members. Connected pivotally between the sets of pivot pins 94, 95, are a pair of hydraulic cylinders 96. When cylinders 96 are hydraulically energized, their lengths between pivot points is reduced, thus pivoting top 90 at 91 to give access to the upper surface of drum 55, and to components carried on top 90.

A portion 96 of top 90 is a cylinder coaxial with drum 55. Secured to the concave side of portion 96 by screws 97 are a plurality of non-magnetic ribs 100 which are generally Z-shaped in cross section and are curved to fit member 96. Secured to ribs 100 along the edge remote from member 90 is a magnetic structure preferably comprising an array of permanent magnets 101, each having an internally threaded aperture 102 for securing the magnets to a member 100 by a screw 103. The magnets are arranged in flat sheets having two edges radial and two edges concentrically arcuate, and the magnetic axes are perpendicular to the sheet with the polarities the same throughout the array, as suggested in FIG. 9. Single magnetic slabs having the desired size and configuration would perhaps be ideal, but the field intensity desired is so high as to dictate barium ferrite for the magnetic material, and it is not economically available in such relatively large sizes.

Ribs 100 are so positioned along top portion 96 that the sheets of magnetics enter the spaces between flanges 72 and 73 in ring 67, so that each body 66 is positioned between two magnetic sheets. This brings up the point that the widths of the bodies, dimension W of FIG. 1, are limited by the field strengths of magnets 101, since even the strongest available magnets are capable of maintaining the desired high magnetic fields over only limited air gaps. Thus, while additional body thickness can be obtained if desired by forming a second, outer body around a first, inner one, the widths of the bodies can only be increased to a certain maximum value.

As shown in FIG. 3, the magnetic structure interdigitates with the separator bodies on the drum for only a limited angular extent near the top of its rotation, say between 60° and 76°. It is within this angle that the principle separation between magnetic and non-magnetic particles takes place. The mixture is supplied to the separator through hopper 104 pivoted to frame structure 50 at 105, see FIG. 3, so that it can be tilted back to permit the opening of top 90 when desired. Hopper 104 terminates at its lower, slanted portion in a row of individual feeder nozzles 106 generally like elements 25 of FIG. 1, which supply mixture to the upper surfaces of the various separator bodies 77 between the flanges 72 and 73, without allowing the mixture to enter the spaces passed through by the magnetic sheets. This factor is a first limitation on the rate of feed of material to the separator. A second limitation is that the feed can not be greater than the amount of material which, if entirely non-magnetic, could flow through its tortuous passages in body 77 and emerge while within the field of a magnetic structure: this maximum must in practice be reduced as the proportion of magnetic material increases, since trapped magnetic material reduces the effective percent void ratio and, hence, the space for passage of non-magnetic material.

The direction of rotation of the drum is shown by the arrow 107, and the feed point must be displaced forwardly from the initial magnets to be sure that a minimum number of particles run backward along the separator bodies and fall untreated to the floor.

Theoretically, only non-magnetic particles fall into the tailings chute, see FIG. 3, and only magnetic particles fall into the concentrate chute: partition 85 is adjustable to improve this separation with variations in the richness of the material being fed to the separator. As a matter of fact, however, there is some tendency for the separator body paths to become plugged, so that material is carried past the point at which it can fall into the concentrate chutes 87. Such material is discharged 180° later in the rotation of the drum, out of the joint effect of gravity and of vibrator 63, and falls to the floor with perhaps a small amount of unsorted material falling directly from the input. While some valueless particulate matter may be found here, it is in general material which has never passed through the machine, and, hence, is appropriate to be returned to hopper 104. This material is given the name "middlings" for the purposes of this application.

Reference should now be made to FIG. 10, which is a flowsheet showing how the embodiment of my invention just described is to be used. It envisages the use of three such separators, or a triple pass of material through a single separator, the number of the machine or pass being indicated as by "Phase I", "Phase II", and so forth. At each phase of the operation there results tailings, concentrate, and middlings. In each case, the concentrate is suitable to be advanced to the next phase, and the middlings are suitable to be returned to the input of the same phase, either concurrently or serially. The tailings from Phase I are essentially worthless and may be discarded. The tailings of each phase subsequent to Phase I, while of less richness than the other two outputs, are nevertheless still worth recycling, and are returned to the input of the next previous phase, so that eventually all gangue appears as tailings 1 and all valuable particles appear as concentrate 3, the output of this flowsheet. The number of stages may be increased to four or decreased to two, for example, at the judgment of the operator.

If the invention is to be used with a slurry rather than with dry material, bodies 62 are preferably made of magnetic stainless steel screen, and water sprays may be added outside the drum over the separating area and inside the drum over the plug releasing area.

The operation of the embodiment of the invention, through a single phase thereof, is as follows. It is assumed that the apparatus has been inspected and is known to be in good condition. Motor 61 is set in operation, causing rotation of drum 55, and vibrator 63 is set in operation, causing the drum to vibrate as well as to be rotated. The mixture of particles to be separated, having been reduced to a size appropriate to pass through the separators bodies, is supplied to hopper 104 and thereby through nozzles 106 to the outer surfaces of bodies 66. Under the influence of gravity and of vibrator 63 the particles begin to pass through the tortuous paths in the separator body, while being carried forward with the body in its rotation. Passage of magnetic particles is opposed magnetically by the poles in the body induced by the magnets 101, while non-magnetic particles not trapped behind such magnetic particles pass through the body and drop into tailings chute 86. As the body passes beyond the magnet structure, the magnetic particles are released, complete the path through the body, and drop, with any non-magnetic particles that have been trapped, and any other unduly delayed particles, into concentrate chute 87. The discharged particles pass by gravity down the chute to suitable recepticles where they represent tailings 1 and concentrate 1.

As the drum continues to rotate, it reaches an attitude in which the tortuous passages are inverted, with respect to gravity, from their initial positions, any plugs which may have incipiently formed in the tortuous paths are now readily removed by vibration and gravity, releasing the trapped particles to fall on the floor under the separator as "middlings 1".

"Tailings 1" is discarded. "Middlings 1" is returned to hopper 104. "Concentrate 1" is advanced to hopper 104 of the next separator and the flowsheet is continued.

At any appropriate maintenance interval, or if special need arises, the feed of mixed particles to hopper 104 may be interrupted, the hopper may be allowed to run empty and pivoted clockwise, in FIG. 3, out of the way, and hydraulic cylinders 96 may be energized to pivot top 90 counterclockwise about points 91 so that both the magnet structure and the drum may be inspected, the latter in operation if necessary.

There are a number of variables in addition to adjustment of partition 85 which one using my invention may wish to consider in adapting the apparatus for handling particulate materials of widely different characters. The magnetic structure may be varied both in configuration and in field strength. The speed of rotation of the drum and the size and spacing of the wires in the screen from which the separator bodies are made are also subject to variation. The rate, amplitude and direction of the applied vibration are also factors which can be varied. Finally, the depth of the separator bodies and the rate at which particulate material is fed to them may also be varied to affect the operation of the separator.

By way of illustration, certain specific parameters, which I have found preferable in at least one embodiment of my invention are as follows. A drum diameter of 36 inches and length of 4 inches, having one axially spaced separator body, each 1.25 inches wide and 4 inches deep. The bodies are formed of 30 layers of steel screen, the wire diameter being 0.015 inches and the wire spacing being 1/16 inch. The magnets, of barium ferrite having a pole strength of 3000 Gauss, are separated by a center distance of 4-¼ inches along the axis of the drum: they are 1 inch thick and extend along 62 degrees of rotation of the drum, with no spacing between them angularly. Drum rotation is 4.3 rpm, material feed may be 26 lbs. per minute, and applied vibration, parallel to the axis, is at 60 Hz frequency with 1/64 inch of double amplitude. The material fed is hematite and silica tailings, particle size about −28 +325 mesh.

Numerous characteristics and advantages of my invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. Separating apparatus comprising, in combination:
- a hollow cylindrical body of formainous, magnetically susceptible material having spaced, substantially plane faces and more widely spaced inner and outer curved surfaces concentric about an axis;
- means mounting said body for rotation about said axis;
- stationary means establishing a magnetic field in a direction parallel to said axis, for lateral traversal by by said body during a portion of the rotation thereof;
- means imparting axial vibration to said body;
- means delivering particulate material to one curved surface of said body near the point where said body enters said field, so that non-magnetic particles pass radially through said body while magnetic particles are retained therein for release when said body leaves said field;
- first discharge means positioned to receive particles passing through said body in the area of said field;
- and second discharge means positioned to receive particles released by said body as it moves out of said field.

2. Apparatus according to claim 1 in which said stationary means comprises:
- an array of fixed permanent magnets laterally apposed to jointly define at least one generally flat structure to which the axis of rotation of the body is orthogonal, the polar axes of said magnets lying substantially parallel to said axis of rotation;
- and means mounting said array adjacent to at least one plane face of said body.

3. Apparatus according to claim 2 in which said array of magnets defines two of said flat structures, and the last named means mounts said structures adjacent both faces of said body.

4. Apparatus according to claim 1 in which said foraminous material comprises a plurality of laminae of reticulate fabric, the planes of the laminae extending generally normal to said axis.

5. Apparatus according to claim 4 in which said fabric is woven from magnetic stainless steel wire.

6. Apparatus according to claim 1 in which said axis is horizontal and the particulate matter is drawn through said body by gravity.

7. Separating apparatus comprising, in combination:
- a plurality of hollow bodies of foraminous, magnetically susceptible material each having spaced, substantially plane faces and more widely spaced inner and outer curved surfaces concentric about an axis;
- means mounting said bodies coaxially for spaced, horizontal rotation about a common longitudinal axis;
- stationary means establishing a magnetic field in a direction parallel to said axis, for traversal by said bodies during a portion of the rotation thereof, said stationary means comprising an array of fixed magnets laterally apposed to jointly define at lease one generally flat structure to which the axis of rotation of the bodies is perpendicular, the polar axes of said magnets lying substantially parallel to said axis of rotation, and means mounting said array adjacent to at least one face of one of said bodies:

means delivering particulate matter to one curved surface of said bodies near the point where said bodies enter said field, so that non-magnetic particles pass through said bodies and magnetic particles are retained therein for release when said bodies leave said field;

first discharge means positioned to receive particles passing through said bodies in the area of said field;

and second discharge means positioned to receive particles released from said bodies after they have moved out of said field.

8. Apparatus according to claim 7 in which said stationary means is located between the bodies of said plurality.

9. Apparatus according to claim 8 in which array of magnets defines a plurality of said flat structures, and the mounting means mounts said structures so that there is one adjacent each face of each of said bodies.

10. Apparatus according to claim 7 in which said bodies are separated by outwardly opening channel members through which said flat structures pass upon rotation of said bodies.

11. The method of separating particles of magnetic and non-magnetic material in a mixture thereof which comprises the steps of:

1. supplying the material to one surface of a moving body of foraminous material;
2. vibrationally promoting the passage of non-magnetic material through said body;
3. magnetically opposing the passage of magnetic particles through said body until passage of said non-magnetic material is substantially complete, and then;
4. vibrationally promoting the passage of said magnetic material through said body.

* * * * *